US005595420A

United States Patent [19]

Rogers

[11] Patent Number: 5,595,420

[45] Date of Patent: Jan. 21, 1997

[54] DUAL-OPERATED MECHANISM FOR REMOTE LATCH ACTUATION

[76] Inventor: W. Clark Rogers, P.O. Box 685, Denton, N.C. 27239

[21] Appl. No.: 302,202

[22] Filed: Sep. 8, 1994

[51] Int. Cl.[6] ..... A47C 1/02

[52] U.S. Cl. ..... 297/85; 297/463.1; 74/500.5; 74/501.6; 74/502; 74/528; 74/545; 74/523

[58] Field of Search ..... 297/85, 463.1, 297/342; 74/500.5, 501.6, 502, 528, 545, 523

[56] References Cited

U.S. PATENT DOCUMENTS

| | | | |
|---|---|---|---|
| 1,735,897 | 11/1929 | Edgar et al. | 74/545 |
| 2,448,696 | 9/1948 | Arens | 74/501.6 |
| 3,143,192 | 8/1964 | Buchanan | 74/500.5 X |
| 3,651,709 | 3/1972 | Booty et al. | 74/500.5 X |
| 4,549,711 | 10/1985 | Giltnane | 248/188 |
| 4,794,820 | 1/1989 | Floeter | 74/500.5 X |
| 4,811,620 | 3/1989 | Old et al. | 74/501.6 X |
| 4,872,366 | 10/1989 | Appleby et al. | 74/500.5 X |
| 4,872,696 | 10/1989 | Gill | 74/500.5 X |
| 4,949,591 | 8/1990 | Roelle | 74/531 |
| 5,010,780 | 4/1991 | Hatfield | 74/501.5 |
| 5,107,720 | 4/1992 | Hatfield | 74/502 |
| 5,131,116 | 7/1992 | Bowdler | 297/463.1 X |
| 5,279,179 | 1/1994 | Yoshigai | 74/500.5 X |

*Primary Examiner*—Milton Nelson, Jr.
*Attorney, Agent, or Firm*—Bell, Seltzer, Park & Gibson, P.A.

[57] ABSTRACT

A mechanism for actuating a remote release device, such as that of reclining seating unit, is disclosed. The mechanism can be actuated by either of two actuation actions, each of which operates independently of the other. The mechanism enables the operator to actuate the device by the method he prefers.

48 Claims, 5 Drawing Sheets

DUAL-OPERATED MECHANISM FOR REMOTE LATCH ACTUATION

FIELD OF THE INVENTION

This invention relates generally to release units, and more specifically relates to mechanisms for actuating remotely located release units.

BACKGROUND OF THE INVENTION

Recliner chairs are seating units that are movable between an upright position, in which the backrest of the chair is disposed generally vertically and the chair seat is disposed generally horizontally and above the chair base, and one or more reclined positions, in which these elements of the chair and others, such as a footrest, move to one or more positions that effectively accommodate an occupant who wishes to stretch out in the chair and relax. The movement of a chair between its upright and reclined positions is generally controlled by a pair of linkages, or mechanisms, each of which comprises a series of pivotally interconnected links. Each mechanism is attached to the chair and directs the movement of the different chair elements to the desired positions.

Recliner chairs often include a device for actuating the chair to move from the upright position to a reclined position. Actuating devices, which are connected with the reclining mechanism, can take different configurations. For example, some chairs, particularly models developed some time ago, include a handle and an axle projecting from the outer portion of one armrest that is connected directly to one of the reclining mechanisms. Rotation of the handle about the axle transmits to the mechanism the torque necessary to move the sections of the chair to one of its reclined positions. Although handle-operated mechanisms have been included on recliner chairs for years, some consumers object to the appearance of a chair having a handle on the outside surface of an armrest. In addition, in protruding outwardly from the armrest, the handle is an obstacle that can be snagged by the clothing of the occupant or struck by a passing child or pet.

In response to consumer dissatisfaction, recliner chairs were developed that have an actuation trigger located within a recess in the lateral portion of the armrest. An example of such a mechanism is disclosed in U.S. Pat. No. 5,107,720 to Hatfield. The Hatfield mechanism includes upright panel, or trigger, that resides within a housing placed in the armrest recess. The panel is connected with a finger which is pivotally connected to the internal surface of the housing. The free end of the finger is attached to one end of a sheathed cable, the opposite end of which is attached to a release latch located on one of the reclining mechanisms. Pulling the trigger outwardly from the housing causes the cable to slide within the sheath and thereby pull on the release latch with sufficient force to cause it to unlock, which action enables the chair, directed by the reclining mechanisms, to move to a reclined position. One shortcoming of this device is that the mechanical leverage provided by the small panel can be somewhat less than that provided by a handle, so its use may be restricted to certain mechanism configurations that require relatively little force to unlock the release mechanism. Also, the housing and trigger are generally rather small, and some occupants, particularly those with long fingernails or physical impairments of the hand, such as arthritis, may find the trigger difficult to operate.

Furniture retailers are generally aware of the consumer perceptions of both the trigger- and handle-actuated mechanisms. Because consumers do not overwhelmingly favor either actuation mechanism type, retailers are faced with the choice of either stocking two recliners of identical style but with different actuation mechanisms or stocking only chairs with one mechanism type and risking lost sales to consumers that disfavor the selected mechanism, neither of which is an attractive choice.

In view of the foregoing, it is an object of the present invention to provide an actuator mechanism configuration that is attractive to and operable by consumers that prefer either a trigger-actuated or a handle-actuated mechanism.

It is another object of the present invention to provide such an actuator mechanism that can be converted between a trigger-actuated mechanism and a handle-actuated mechanism at a furniture retailer's showroom or even at a consumer's home.

It is a further object of the present invention to provide such a mechanism that can be used with recliner chair mechanisms that are currently available.

It is also an object of the present invention to provide such a mechanism that does not negatively impact the design or style of a recliner chair to which it is attached.

SUMMARY OF THE INVENTION

These and other objects are satisfied by the present invention, which relates to a mechanism for actuating a remote unit with an actuating member. The mechanism comprises a housing, first actuating means for moving the actuating member along a path between first and second translatory positions, and second actuating means for moving the actuating member along the same path. The first actuating means is movable between first and second positions relative to the housing; the actuating member moves between its first and second translatory positions in response the corresponding movement of the first actuating means. The second actuating means includes rotating means that is pivotable about an axis of rotation that is nonparallel with the path taken by the actuating member. Rotation of the second actuating means between first and second rotative positions causes the actuating member to move between its first and second positions.

Preferably, the mechanism includes a lever arm that is pivotally interconnected with the housing and which is adapted to be connected with the actuating member. In such an embodiment, both the first and second actuating means are then connected with the lever arm. The lever arm pivots about a pivot axis responsive to movement of either the first or second actuating means. In a particularly preferred embodiment, the first actuating means comprises an operating plate that can be moved laterally to actuate the lever arm, and the second actuating means comprises a handle-driven spool that rotates about a pivot axis that is substantially perpendicular to the pivot axis of the lever arm. It is also preferred that both the first and the second actuating means include lost motion means that permits either of these actuating means to operate independently of the other.

The present invention is particularly suitable for use with a reclining seating unit. When the preferred embodiment described above is attached to a reclining seating unit, the occupant of the seating unit can choose whether to actuate the reclining mechanism of the seating unit with the operating plate or with the handle depending on the operator's personal preference.

DETAILED DESCRIPTION OF THE INVENTION

Figure 1:
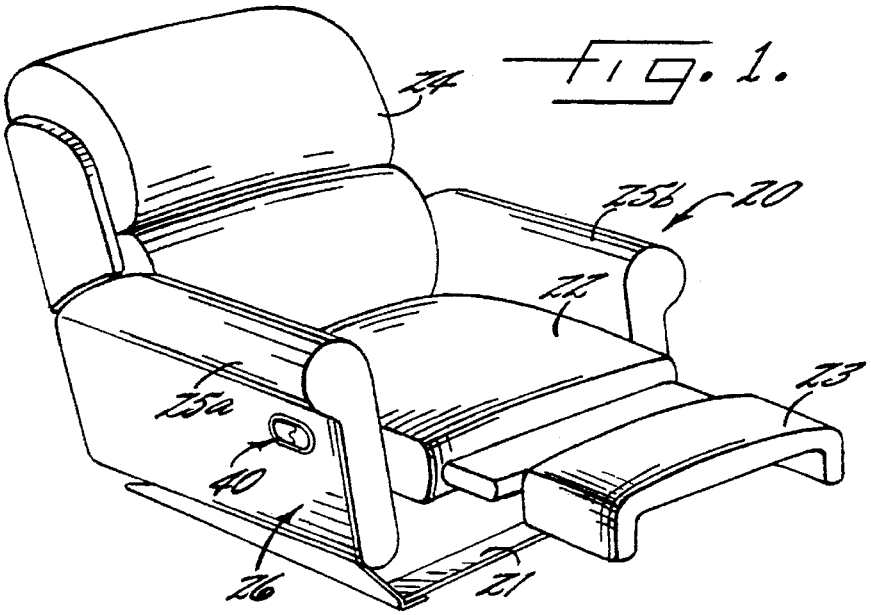
FIG. 1 is a perspective view of a recliner chair in its reclined TV position with its footrest extended.

The present invention will now be described in greater detail hereinbelow. This invention may be embodied in many forms and should not be construed as limited to the embodiments set forth herein; instead, these embodiments are provided so that this disclosure will be thorough and complete, and will fully convey the scope of the invention to those skilled in the art.

In the ensuing description, the positions of certain structures of an actuating mechanism of the present invention, which are illustratively shown attached to a recliner chair, will at times be described with reference to the positions of other structures of the actuating mechanism and the chair in order to convey the spatial orientation of these structures to one another. As used herein, the terms "front," "forward," "forwardly," and derivatives thereof refer to the direction defined by a vector parallel to the line formed by a plane extending parallel to the surface underlying the chair and a plane bisecting the chair between its armrests, wherein the vector originates at the backrest and extends toward the footrest of the chair. The terms "rear," "rearwardly," and derivatives thereof refer to the direction that is directly opposite the forward direction. The terms "lateral," "outward," and derivatives thereof describe the direction defined by vectors parallel to a line that is orthogonal to a plane bisecting the chair, wherein the vectors originate at the bisecting plane and extend therefrom toward the armrests. Conversely, the terms "inward," "inboard," and derivatives thereof refer to the directions opposite the lateral directions: i.e., the directions extending from the armrests toward the bisecting plane described above.

In addition, the following definitions of terms known in this art will facilitate a more complete understanding of the invention. As used herein, "upright position" means the position of a recliner chair which exists when the chair is unoccupied, with the backrest in its most upright position and with the footrest retracted beneath the seat. "Fully reclined position" means the position of a recliner chair in which the backrest has been reclined to its shallowest angle relative to the floor. "TV position" means an intermediate reclined position of a recliner chair in which the footrest extends forwardly from the chair while the backrest is in an upright or a substantially upright position. A "one-way" recliner means a chair which includes a seat and headrest rigidly fixed to one another, and which is movable between an upright and a fully reclined position. A "two-way" recliner means a recliner chair which includes a seat and backrest that are rigidly fixed to each other to always move in concert, and which is movable between an upright position, a TV position, and a fully reclined position. A "three-way" recliner means a recliner chair in which the backrest may pivot into reclining positions relative to the seat, in which the seat also is capable of moving into reclining positions relative to a fixed base, the angle between the backrest and seat being variable in different reclining positions, and which is movable between an upright position, a TV position, and a fully reclined position. A "wall-avoiding" recliner means a type of recliner chair in which, as the chair moves to a reclining position, portions of the backrest of the chair also move forwardly; if the backrest of a wall-avoiding chair is placed substantially adjacent a wall, the backrest will not strike the wall during reclining or retraction of the chair.

Figure 2:
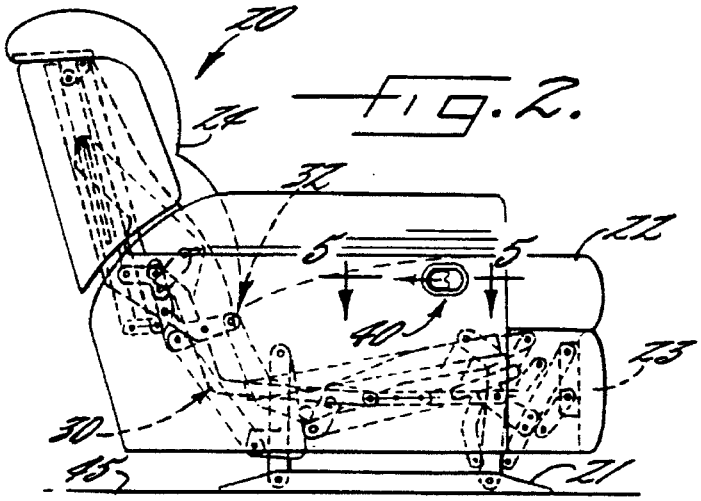
FIG. 2 is a side elevation view of the recliner chair of FIG. 1 in its upright position.
Figure 3:
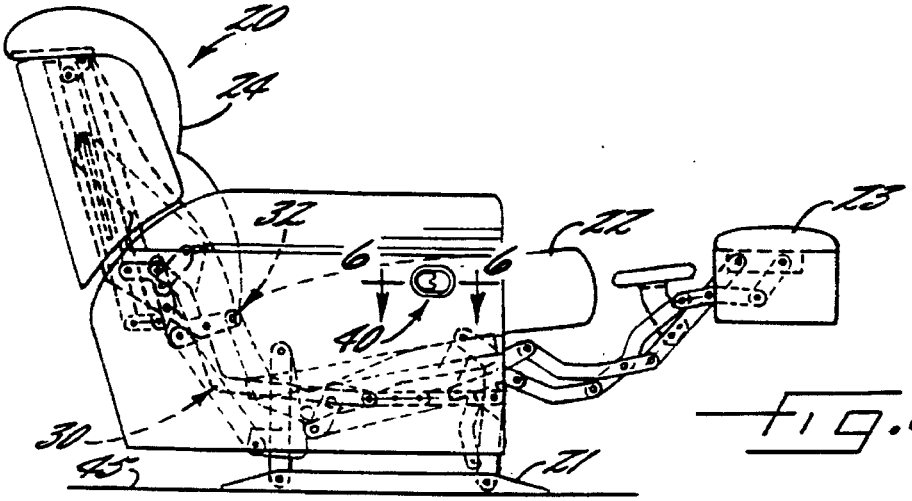
FIG. 3 is a side elevation view of the recliner chair of FIG. 1 in its reclined TV position with its footrest extended.

Referring now to the drawings, FIG. 1 shows a three-way recliner chair, designated broadly at 20, that comprises a base 21 configured to support the chair 20 on an underlying surface, a seat portion 22 positioned generally above the base 21, a backrest 24 disposed generally upright and located generally above the rear portion of the base 21, a pair of armrests 25*a*, 25*b*, which are positioned laterally from the seat section 22, and a footrest 23. The chair 20 is movable between an upright position, shown in FIG. 2, in which the footrest 23 is positioned below the front portion of the seat section 22, and a reclined TV position, shown in FIG. 3, in which the footrest is disposed generally horizontally and in front of the seat section 22. The chair 20 can also be further reclined to a fully reclined position (not shown). Although the chair illustrated herein is a three-way chair, those skilled in this art will appreciate that the present invention can be employed with one-way and two-way recliners also, and moreover can be employed with both wall-avoiding and nonwall-avoiding models. Also, although a recliner chair is illustrated herein, those skilled in this art will appreciate that the present invention can be used with other reclining seating units, such as love seats, sofas, pit groups, "side-by-side" recliner units (exemplified by U.S. Pat. No. 5,106,153 to Durling), and the like, that include a remote release unit that can be actuated by the translatory motion of an actuating member, such as a cable or rod.

The movement of the chair 20 between its upright and reclined positions is controlled by a pair of mirror-image reclining mechanisms 30, each of which is pivotally interconnected to the base the seat 22, the footrest 23, and the backrest 24. The reclining mechanisms 30 are illustrative of reclining mechanisms known to those skilled in this art to be suitable for use in reclining seating units. The reclining mechanism 30 includes a release mechanism 32, which is configured such that its individual links take a locked "over-center" arrangement when the release mechanisms 32 is in its locked position. As the release mechanism 32 is released from its locked position, the chair 20 is free to move from the upright position illustrated in FIG. 2 to the TV position illustrated in FIGS. 1 and 3. The large majority of the force that drives the reclining mechanism 30, and correspondingly, the chair 20, to its TV position is provided by the weight of the chair's occupant. However, those skilled in this art will appreciate that other mechanisms that are based on "gravity-assisted" movement, mechanisms that require the application of force to an actuating unit for the chair to move to a reclined position, and mechanisms that are driven by a combination of occupant weight and mechanical force, are suitable for use with this invention.

Figures 4, 5:
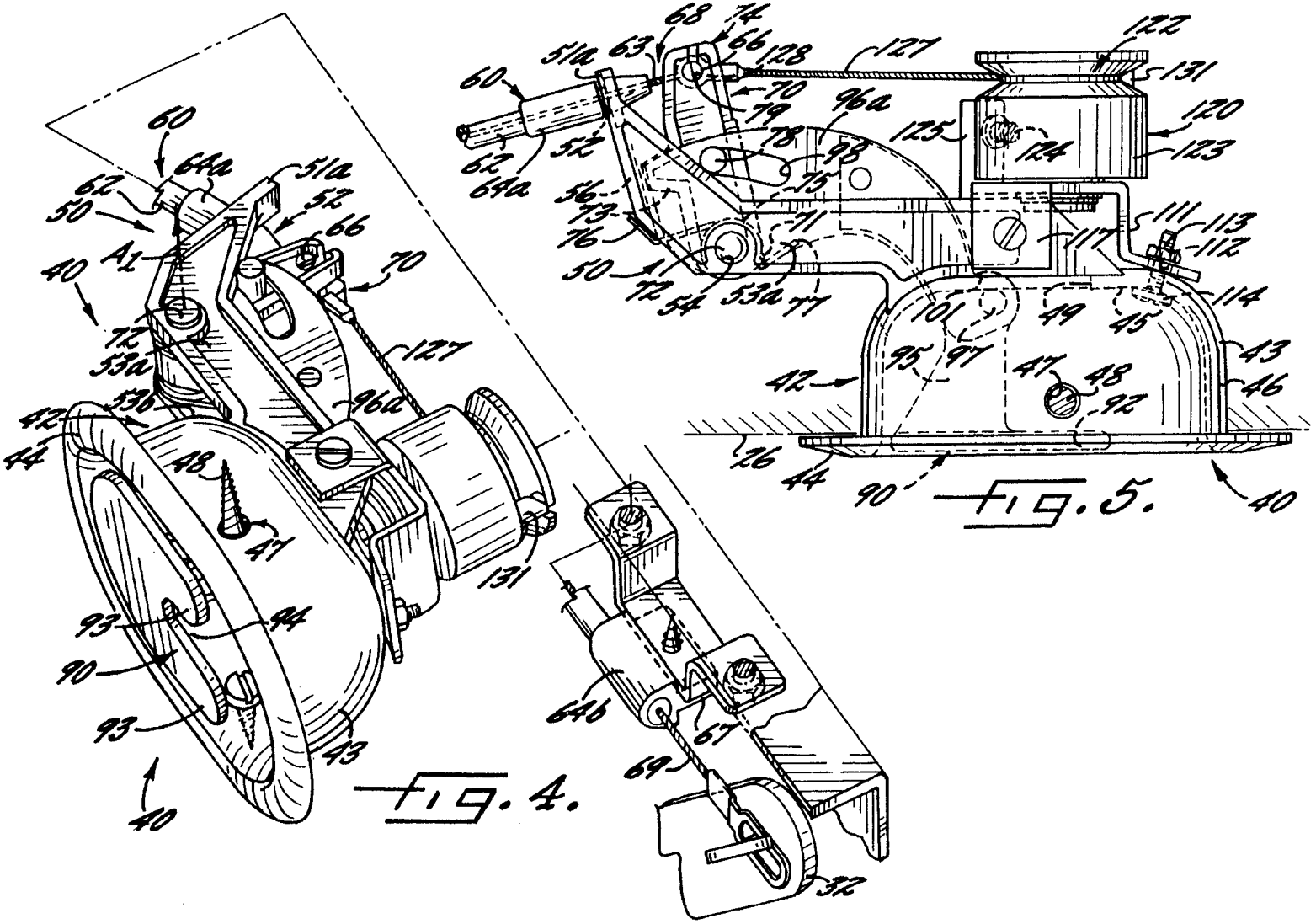
FIG. 4 is a perspective view of an actuating mechanism in its retracted position with its accompanying cable represented schematically.
FIG. 5 is a top cross-sectional view taken along line 5—5 of FIG. 2 that shows the actuating mechanism in its retracted position.

As is shown schematically in FIGS. 2 through 5, an actuating mechanism 40 is mounted to the lateral surface 26 of the armrest 25*a* and is connected with the release mechanism 32 of the reclining mechanism 30 via a sheathed cable 60. The actuating mechanism 40 is employed to unlock the release mechanism 32 from its locked position, thereby actuating movement of the chair 20 to its TV position. Referring now to FIGS. 4 and 5, the actuating mechanism 40 comprises a housing 42, a sheathed cable unit 60, a lever arm 70, a trigger unit 90, and a handle unit 110. The housing 42 comprises a cup-shaped socket portion 43 that projects inwardly into the armrest 25*a* from the lateral armrest surface 26, a circumferential lip 44 attached to the lateral edges of the socket portions 43 that overlies the lateral armrest surface 26, and an inwardly and rearwardly extending housing extension frame 50. The socket portion 43 includes an inboard floor 45 that merges at its periphery with side walls 46. The housing 42 is mounted to the armrest 25*a* with two threaded fasteners 48, which are inserted through apertures 47 located on the upper and lower surfaces of side walls 46. A large actuator aperture 49 is included in the floor 45; the actuator aperture 49 is sized to enable portions of a trigger unit 90 and a handle unit 110 to travel therethrough during operation of the actuating mechanism 40.

Figure 6:
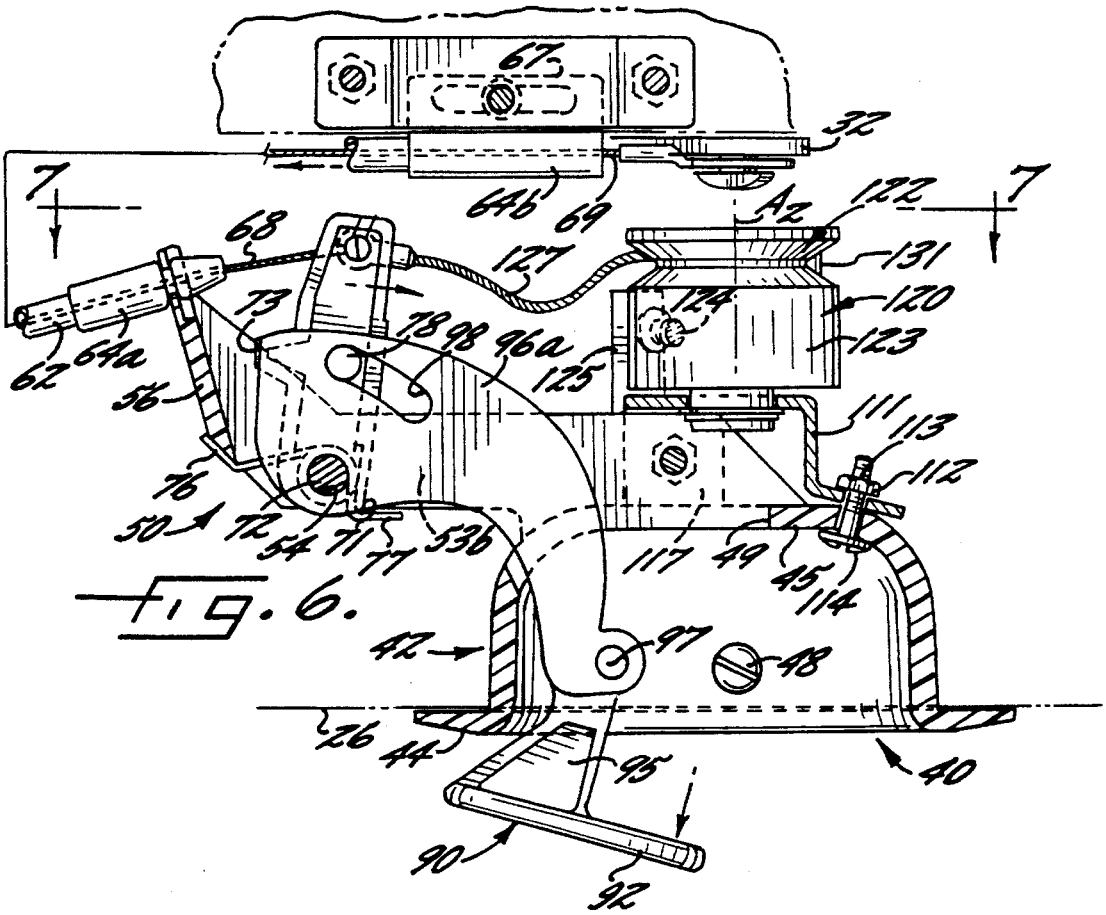
FIG. 6 is a top cross-sectional view taken along line 6—6 of FIG. 3 showing the operating plate of the actuating mechanism in its extended position.

The housing extension frame 50 is attached to the inward surface of the floor 45 of the housing and extends rearwardly and inwardly therefrom (FIGS. 4 through 6). The extension frame 50 includes a pair of identical rearwardly extending segments 53*a*, 53*b* that extend rearwardly from the inboard surface of the floor 45 and that merge an inwardly extending plate 56. A pair of fingers 51*a*, 51*b* (FIG. 7) extend inwardly from the inward edge portion of the plate 56. A sheath slot 52 is defined by the fingers 51*a*, 51*b* and the plate 56. A pivot aperture 54 is located at the junction in the frame 50 between the segments 53*a*, 53*b* and the plate 56.

As shown in FIGS. 4 and 6, the sheathed cable unit 60 extends between the fingers 51*a*, 51*b* and the release mechanism 32. The cable unit 60 comprises an elongated external sheath 62, a cable 63 captured therein, and a pair of sheath end caps 64*a*, 64*b* which anchor the cable unit 60, respectively, in the slot 52 and to a mounting bracket 67 fixed to the recliner mechanism 30. The cable 63 is connected at one end 68 to the lever arm 70 and at its opposite end 69 to the release mechanism 32. Although the cable 63 is captured within the sheath 62, the cable 63 is free to slide longitudinally therein; thus moving the cable 63 so that the end 69 is drawn toward the mounting bracket 67 in turn draws a link of the release mechanism 32 (FIG. 6) so that it moves from its over-center locked position, thereby enabling the chair 20 to move to its TV position. Although the cable unit 60 is illustrated and preferred, those skilled in this art will understand that any member that can transmit movement of the actuating mechanism 40 to the release mechanism 32 is suitable for use with the present invention. Exemplary alternatives include an unsheathed cable and, for certain configurations, a rod or other relatively rigid member.

Figure 7:
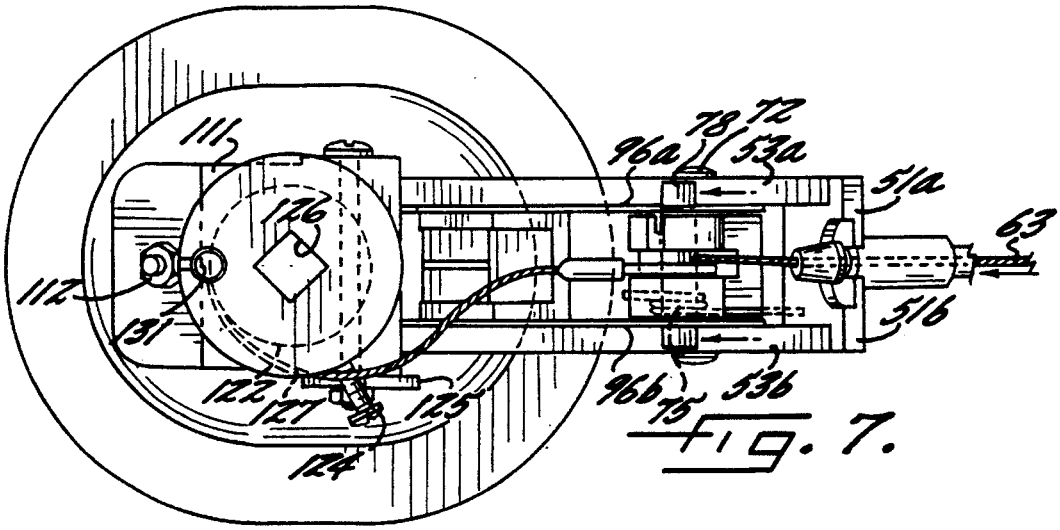
FIG. 7 is an internal side view taken along line 7—7 of FIG. 6 showing the lever arm of the actuating mechanism in its extended position.
Figure 8:
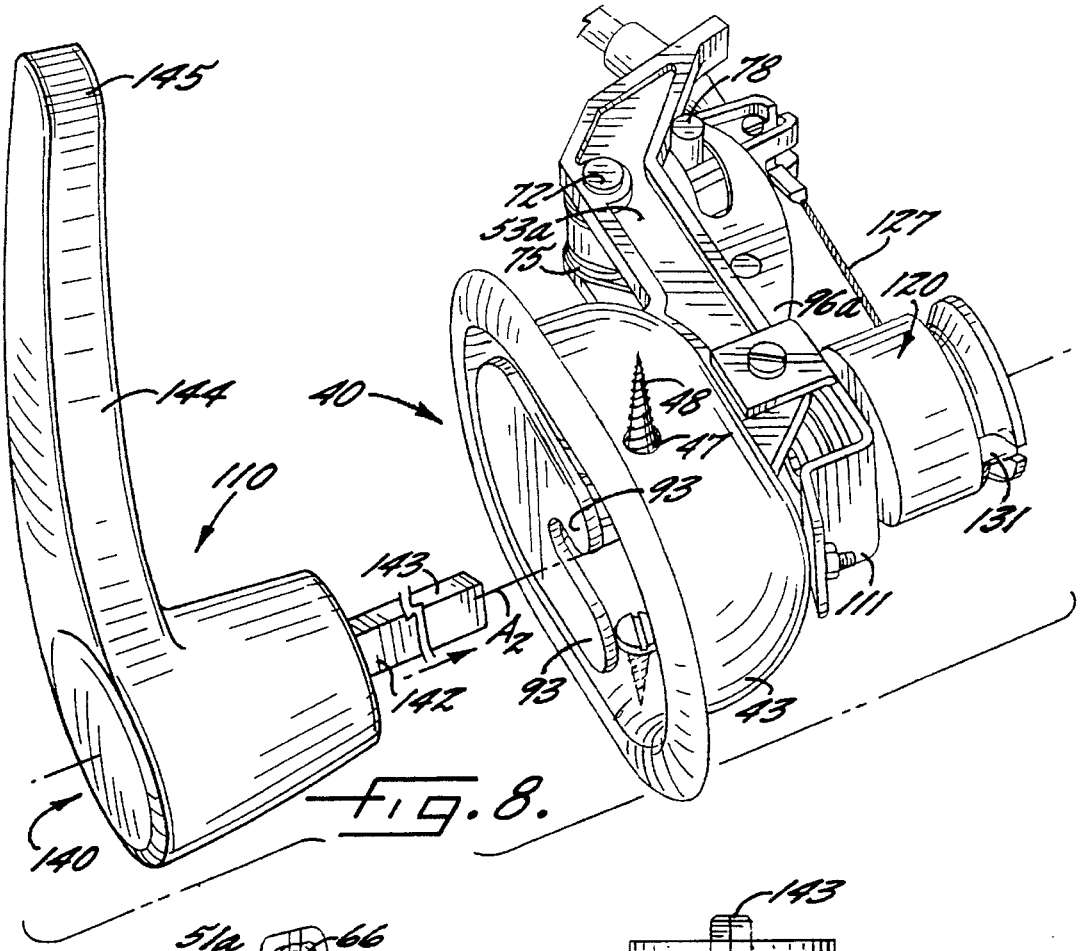
FIG. 8 is an exploded perspective view of the actuating mechanism of FIG. 4 and its actuating handle unit.

The lever arm 70 (FIGS. 4 through 6) is pivotally attached to the housing frame 50 between the segments 53*a*, 53*b* by a pivot pin 72, which is inserted through the pivot apertures 54 of the frame 50 and a bore (not shown) in the lever arm 70. The free end portion 74 of the lever arm 70 is free to pivot about a pivot axis $A_1$ defined by the longitudinal axis of the pivot pin 72 (FIGS. 4 and 7). The lever arm 70 includes a stop rib 73, which protrudes from the central rear portion of the lever arm 70 to contact the plate 56 when the lever arm 70 is in its retracted position. The cable 63 is attached to the free end portion 74 of the lever arm 70 via a cable attachment pin 66, which is captured within a cable pin aperture 79. A helical spring 75 is coiled around the pivot pin 72. The spring 75 includes a stationary end portion 76, which rests against the rearward portion of the plate 56, and further includes a pivoting end 77 of the spring 75, which rests against the forward lateral edge 71 of the lever arm 70 and is movable therewith. A vertical alignment pin 78 protrudes from the upper and lower surfaces of the central portion of the lever arm 70.

The trigger unit 90 comprises an operating plate 92 and a pair of pivot plates 96*a*, 96*b*. The pivot plates 96*a*, are generally planar and arcuate in shape and are pivotally connected with the frame 50 by the pivot pin 72, which extends through the plates 96*a*, 96*b*. The pivot plates 96*a*, 96*b* are positioned just above and just below, respectively, the lever arm 70, and just below and just above, respectively, the segments 53*a*, 53*b* of the frame 50. Each of the pivot plates includes a slot 98 that mates with and captures the lever arm alignment pin 78. The lateral most portions of the pivot plates 96*a*, 96*b*, extend through the actuator aperture 49 and are fixed via a fastener 97 to a post 95 that extends inwardly from the operating plate 92; as a result, the pivot plates 96*a*, 96*b* and the operating plate 92 move as a single integrated unit. The operating plate 92 is disposed generally vertically and in general vertical alignment with the lip 44 so that the lateral surface of the operating plate 92 is essentially coplanar with the lateralmost edge portion of the lip 44 (FIGS. 5 and 7). A pair of fingers 93 extend forwardly from the operating plate 92 and form therebetween a slot 94. Those skilled in this art will appreciate that, although the trigger unit 90 is preferred, any actuating means for moving the cable or any other actuating member along a path defined by first and second translatory positions responsive to movement of the actuating means from a first to a second position is suitable for use with the present invention. For example, a bolt-action mechanism, such as is often employed with slidable door locks, can be employed.

Figure 9:
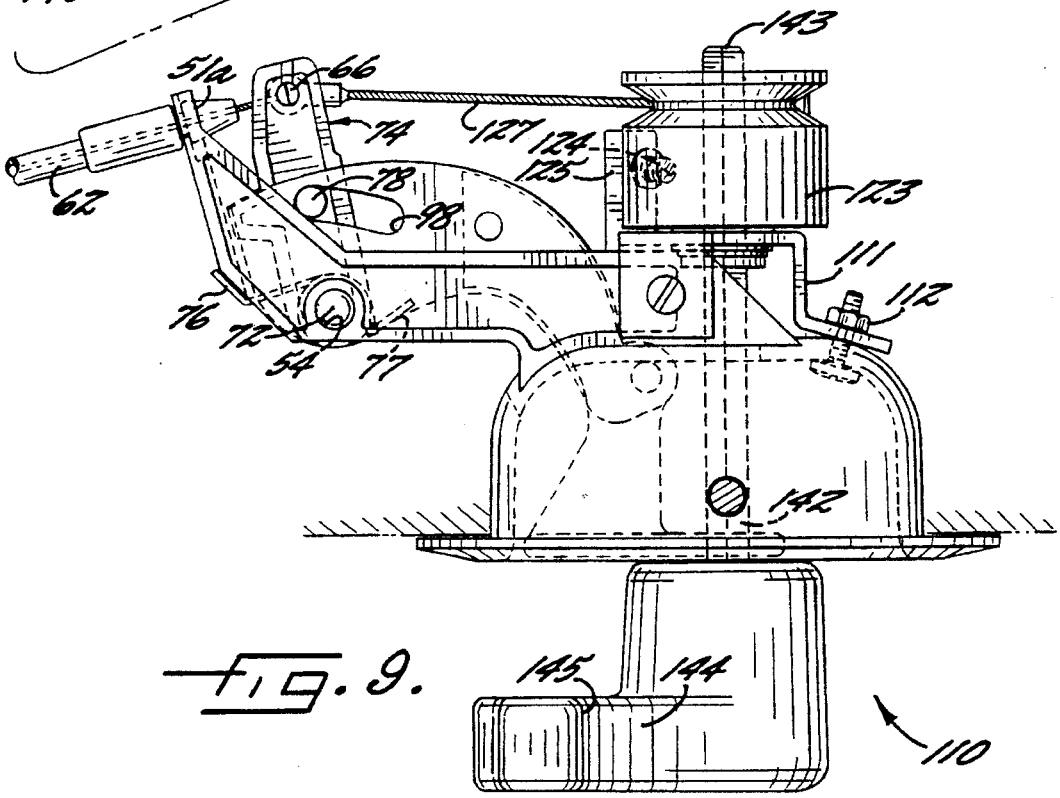
FIG. 9 is a top view of the actuating mechanism of FIG. 8 with the handle engaged and in its retracted position.
Figure 10:
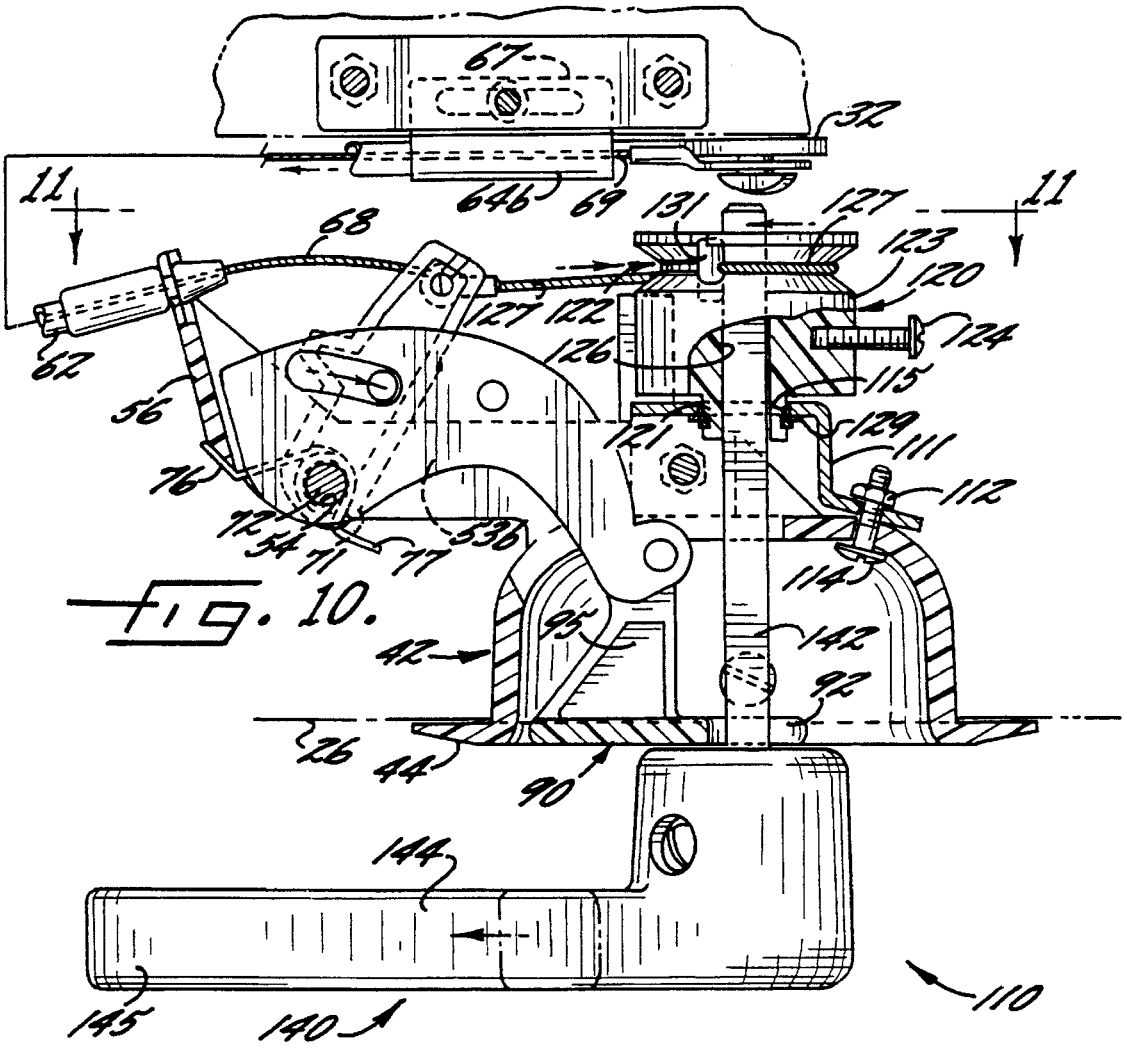
FIG. 10 is a partial cutaway top view of the actuating mechanism with the handle in its extended position.
Figure 11:
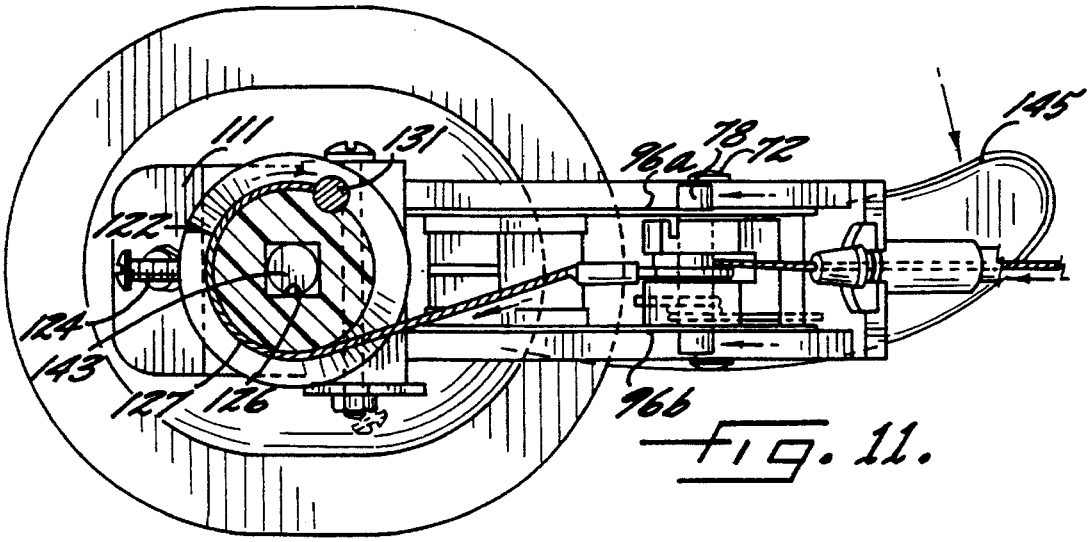
FIG. 11 is an internal side view taken along line 11—11 of FIG. 10 showing the handle unit in its extended position.

The handle unit 110 (FIGS. 8 through 11) comprises a mounting bracket 111 and a spool 120. The mounting bracket 111 (FIGS. 9 and 10) is mounted to the forward portion of the inward surface of the floor 45 by a bolt 114, which extends through a mounting aperture 112 and is received within a nut 113. The mounting portion 117 of the mounting bracket 111 is positioned inwardly from the actuator aperture 49 and is substantially parallel with the floor 45. It includes therein a spool aperture 115 for receiving the shaft 121 of the spool 120. The shaft 121 is retained in the spool aperture 115 by a lock ring 129 that restricts longitudinal movement of the spool 121 but which permits the spool 120 to rotate about an axis of rotation $A_2$ that coincides with the longitudinal axis of the shaft 121. Preferably, the axis $A_2$ is substantially perpendicular to the axis $A_1$, although those skilled in this art will appreciate that the spool 120 or other rotating means can be mounted in any manner relative to the housing 42 so that the axis of rotation of the spool 120 is nonparallel with the path taken by the cable end 68 as it travels from its retracted to its extended position in response to rotating of the rotating means. The spool 120 further comprises a short cylinder 123 having a butterfly notch 122 in its inward portion. A stop screw 124 is received in the cylinder 123 and extends radially outwardly therefrom. A stop post 125 extends inwardly from the lower forward portion of the frame 50 to contact the stop screw 124 as it travels thereto. A flexible cord 127 is attached at one end in the butterfly notch 122 via a post 131 and at its opposite end to the cable pin aperture 79 via an eyelet 128; this cord could be replaced with a rod or other means interconnecting the lever arm 70 with the spool 120. A square handle aperture 126 (FIG. 11) extends longitudinally into the central lateral portion of the shaft 121. Those skilled in this art will appreciate that although the spool 120 is preferred, any take-up means for drawing the cord 127 or other interconnecting means and the lever arm free end 74 forwardly away from the fingers 51*a*, 51*b* is suitable for use with the present invention.

A handle assembly 140 is illustrated in FIGS. 8 through 11. The handle assembly 140 comprises a crank axle 142 of square cross-section having an insertable end 143, which is configured to be received within the handle aperture 126 of the spool 120, and a handle 144, which is fixed to the end of the crank axle 142 opposite the insertable end 143. The handle 144 includes a free end 145 that is rotatable about the axis $A_2$. The crank axle 142 and the handle aperture 126 can be configured so that the crank axle 142 can be releasably secured in the handle aperture 126, or, alternatively, they can be configured so that the crank axle 142 is permanently secured in the handle aperture 126 upon insertion.

The chair 20 can be actuated to move from its upright position to its TV position with either the trigger unit 90 or the handle unit 110, depending on the preference of the occupant. In either instance, the actuating mechanism 40 begins with the cable unit 60, the lever arm 70, the trigger unit 90 and the handle unit 110 in their respective retracted positions. As seen in FIGS. 4 and 5, in the retracted position the operating plate 92 is essentially coplanar with the circumferential lip 44 of the housing 42. The pivot plates 96*a*, 96*b*, are positioned inwardly of the socket 43 with the exception of the pivot plate tab 101, which resides within the cavity defined by the housing socket portion 43. The lever arm 70 is retracted so that the stop rib 73 contacts the housing frame 50 and so that the alignment pin 78 is located in the rearmost portion of its receiving slot 98. The lever arm 70 is retained in this retracted position by the spring 75, which biases the lever arm 70 toward this position. As the free end portion 74 of the lever arm 70 is in its rearward most position, the cable 63 is in a first translatory position in which the end 68 of the cable 63 is adjacent the sheath cap 64*a*, and the end 69 of the cable 63 is spaced away from the sheath cap 64*b*. The release mechanism 32 is in its locked position.

In addition, when the chair 20 is in its upright position, the spool 120 is in a first rotative position in which the stop screw 124 is in adjacent contacting relation with the forward edge of the stop post 125. Because the rotation of the spool 120 is constrained by the stop screw 124 and post 125 and the lever arm 70 is forced into its retracted position by the spring 75, the cord 127 extending between the lever arm 70 and the spool 120 is taut.

To operate the actuating mechanism 40 with the trigger unit 90, the occupant applies a laterally directed force to the operating plate 92; this force is typically applied by placing one or more fingers on the inward surface of the operating plate 92 and pulling it laterally. As the operating plate 92 moves laterally and slightly rearwardly (as shown in FIG. 6), the pivot plates 96*a*, 96*b* pivot about the pivot pin 72 so that the tab 101 moves laterally and rearwardly. Because the alignment pin 78 is positioned in the rearwardmost portion of the slot 98, the movement of the pivot plates 96*a*, 96*b* draws the lever arm free end portion 74 forward as the lever arm 70 also pivots about pivot pin 72. The forward movement of the free end portion 74 causes the cable 63 to slide longitudinally relative to the sheath 62 to a second translatory position, with cable end 68 being spaced away from the sheath cap 64*a* and cable end 69 moving adjacent sheath cap 64*b*. Movement of the cable end 69 toward the sheath cap 64*b* draws the portion of the release mechanism 32 to which it is connected toward the sheath cap mounting bracket 67, which movement is sufficient to release the release mechanism 32 from its locked position. Once the release mechanism 32 is unlocked, the weight of the seat 22 and the occupant force the chair 20 to move from its upright position to its TV position.

Because of the presence of the spring 75, which has been placed in tension by the movement of the pivot plates 96*a*, 96*b*, after the release mechanism 32 has unlocked and the chair 20 has moved to a reclined position, release of the operating plate 92 by the occupant causes the operating plate 92 to return its retracted position, where it remains as the chair 20 is in it TV position. Those skilled in this art will appreciate that, although the illustrated helical spring 75 is preferred, any means for biasing the lever arm 70 toward its retracted position, such as an elastic strap, a leaf spring, and the like, can be used with the present invention.

To actuate the reclining mechanism 30 using the handle unit 110 rather than the trigger unit 90, initially the insertable end 143 of the crank axle 142 is inserted into the handle aperture 126 (see FIGS. 8 and 9) so that the lateral portion of the crank axle 142 fits within the slot 94 of the operating plate 92. The handle unit 110 begins in the first rotative position as described above. The occupant applies a rearwardly and downwardly directed force to the free end 145 of the handle 144, thereby causing the crank axle 142 to pivot about the pivot axis $A_2$. Rotation of the crank axle 142 causes the spool 120 to rotate from its first rotative position to a second rotative position in which the stop screw 124 faces generally forwardly (see FIGS. 10 and 11). The post 131 connecting the cord 127 to the spool 120 moves away from the cable sheath cap 64*a*; thus as the spool 120 rotates, the cord 127 is wound around the spool 120 and is captured within the butterfly notch 122. This movement pulls the free end portion 74 of the lever arm 70 forwardly, which in turn draws the cable end 68 forwardly. As discussed above, forward movement of the cable end 68 causes the cable end 69 to move adjacent the sheath cap 64*a*, which in turn unlocks the release mechanism 32. As described above for the trigger unit 90, the biasing of the spring 75 on the lever arm 70 causes both the lever arm 70 and the spool 120 to return to their respective retracted positions after the occupant releases the handle 144.

Those skilled in this art will understand that, although the handle-driven spool illustrated herein is preferred, any means for moving an actuating member, such as the cable 63, along a path defined by first and second translatory positions that includes rotating means pivotable about an axis of rotation that is nonparallel to the translatory path of the actuating member is suitable for use with this invention. An exemplary alternative is a handle-driven rack-and-pinion assembly.

Notably, as the handle unit 11 is actuated, the operating plate 92 remains essentially stationary. This is made possible by the inclusion of the slot 98 in the pivot plates 96*a*, 96*b*. As the lever arm 70 pivots about the pivot pin 72 in response to the rotation of the spool 120, the alignment pin 78 moves forwardly within the slot 98; however, the slot 98 is sufficient in length that the action of the lever arm 70 is complete before the alignment pin 78 reaches the forward end of the slot 98. As the pivot plates 96*a*, 96*b* do not move, there is no structure to force the operating plate 92 to move laterally in response to the movement of the handle unit 110. Similarly, actuation of the actuating mechanism 40 via the trigger unit 90 does not cause the handle unit 110 to rotate. As the free end portion 74 of the lever arm 70 moves forwardly in response to lateral movement of the operating plate 92, the cord 127 becomes limp and thus does not induce movement of the spool 120 (FIGS. 6 and 7). Those skilled in this art will appreciate that, although use of the cord 127 to interconnect the handle unit 110 with the lever arm 70, other lost-motion means, such as four-bar linkages, springs, and the like, can also be used with this invention.

Also, those skilled in this art will appreciate that, although illustratively the spool rotates from its first to its second rotative position and the operating plate 92 moves laterally to its extended position so that the cable 63 is drawn toward the housing 50 and away from the release mechanism 32, the invention could be configured so that the rotative direction of spool rotation and the movement of the operating plate 92 is reversed, with the result that the cable 63 is pushed away from the housing 63 and toward the release mechanism 32 if the release mechanism so requires.

The present invention thus enables the manufacturer of a reclining seating unit to offer to the consumer a choice between actuating the reclining mechanism with a trigger or a handle. In either instance, the operation of the selected actuation device is not in any way affected by the structure associated with the other actuation option. As such, retailers are able to present the consumer with both options on the showroom floor without having to stock multiple chairs of the same style having different actuating mechanisms. Similarly, in the home, the consumer can actuate the chair with either actuation unit.

In addition, it should be apparent that the present invention can be used to actuate release units associated with articles other than reclining seating units, and in fact is suitable for use with virtually any remote release unit that can be released by the actuation of translatory movement of an actuating member. Exemplary articles include gear shifting units on bicycles and automobiles, and the like.

The foregoing examples are illustrative of the present invention, and are not to be construed as limiting thereof. The invention is defined by the following claims, with equivalents of the claims to be included therein.

That which is claimed is:

1. A mechanism for actuating a remote unit with an actuating member, comprising:

a housing;

first actuating means connected with said housing and adapted to be connected with the actuating member for moving the actuating member along a path between first and second translatory positions, said first actuating means being movable between first and second positions relative to said housing, wherein the actuating member moves between its first and second translatory positions responsive to movement of said first actuating means between its first and second positions; and second actuating means attached to said housing and adapted to be connected with the actuating member for moving the actuating member along the path between its first and second translatory positions, said second actuating means including rotating means pivotable about an axis of rotation between first and second rotative positions, said axis of rotation being nonparallel with the path between the first and second translatory positions, wherein the actuating member moves between its first and second translatory positions responsive to the rotation of said rotating means between the first and second rotative positions, said rotating means further including means for receiving a releasably connectable crank axle for facilitating the rotation thereof.

2. The mechanism defined in claim 1, wherein said axis of rotation is substantially perpendicular to the path of the actuating member.

3. The mechanism defined in claim 1, further comprising a lever arm pivotally connected to said housing to define a pivot axis and to be pivotable thereabout between a first position and a second position corresponding to the first and second translatory positions of the actuating member, said lever arm having a free end portion adapted to be connected with the actuating member, wherein said first actuating means further includes first means for interconnecting said lever arm with said first actuating means so that movement of said first actuating means from its first position to its second position causes said lever arm to move from its first position to its second position, and wherein said second actuating means further includes second means interconnecting said second actuating means with said lever arm so that rotation of said rotating means from its first rotative position to its second rotative position causes said lever arm to move from its first to its second position.

4. The mechanism defined in claim 3, wherein said rotating means comprises take-up means interconnected with said second interconnecting means, and wherein rotation of said rotating means from its first to its second rotative position causes said lever arm to draw the actuating member toward said housing.

5. The mechanism defined in claim 3, wherein said first actuating means is configured so that movement thereof from its first to its second position causes said lever arm to draw the actuating member toward said housing.

6. The mechanism defined in claim 3, wherein said lever arm pivot axis is substantially perpendicular to said second actuating means axis of rotation.

7. The mechanism defined in claim 3, wherein said first actuating means further comprises an operating plate moveable between a retracted and an extended position, wherein said lever arm moves between its first and second positions responsive to movement of said operating plate between its retracted and extended positions, and wherein in its retracted position, said operating plate defines a plane substantially orthogonal with the axis of rotation of said second actuating means.

8. A mechanism for moving an actuating member between retracted and extended positions comprising:

a housing, a lever arm directly and pivotally connected to said housing to define a pivot axis and to be pivotable thereabout between a first retracted position and a second extended position, said lever arm having a free end portion adapted to be connected with an actuating member, first actuator means for pivoting said lever arm from its retracted position to its extended position, and including operating means movable between retracted and extended positions, and first interconnecting means interconnecting said lever arm and said operating means such that the lever arm will be pivoted from its retracted position toward its extended position upon a corresponding movement of said operating means, said first interconnecting means extending between and connected to said lever arm and said operating means, and said first actuator means be in directly connected to said housing, and second actuator means for pivoting said lever arm from its retracted position to its extended position independently of the operation of said first actuator means, and including take-up means rotatably mounted to said housing and second interconnecting means interconnecting said lever arm and said take-up means so that rotation of said take-up means in a first rotative direction causes the lever arm to pivot from its retracted position toward its extended position, said second interconnecting means extending between and connected to said lever arm and said take-up means, and said second actuator means being directly connected to said housing.

9. The mechanism defined in claim 8, further comprising biasing means connected with said lever arm for biasing said lever arm toward its retracted position.

10. The mechanism defined in claim 8, wherein said take-up means comprises a spool, and wherein said second interconnecting means comprises cable means having one end connected to said lever arm and a second end connected with said spool so that rotation of said spool causes said cable means to wind upon said spool and thereby pivot said lever arm from its retracted to its extended position.

11. The mechanism defined in claim 10, wherein said spool is rotatably mounted to said housing for rotation about an axis which is substantially perpendicular to said pivot axis.

12. The mechanism defined in claim 10, wherein said spool further includes means for receiving a releasably connectable crank axle for facilitating the rotation thereof.

13. The mechanism defined in claim 12, wherein said operating plate includes means aligned with the rotational axis of said spool adapted to receive the crank axle when the crank axle is connected with said spool.

14. The mechanism defined in claim 13, wherein said spool further comprises stop means for preventing counter rotation of said spool in a second rotative direction opposite said first rotative direction when said lever arm is in its retracted position.

15. The mechanism defined in claim 10, wherein said first actuator means is pivotally interconnected with said housing.

16. The mechanism defined in claim 15, wherein said operating means is connected to said housing for pivotal movement about said pivot axis.

17. The mechanism defined in claim 16, wherein said operating means comprises an operating plate, and wherein said means interconnecting said operating plate and said lever arm includes lost motion interconnection means for causing said lever arm to pivot from its retracted position to its extended position upon a corresponding pivotal movement of said operating plate while permitting pivotal movement of said lever arm between its retracted and extended positions in response to rotation of said spool without causing a corresponding pivotal movement of said operating plate.

18. The mechanism defined in claim 17, wherein said housing is cup-shaped with a circumferential lip portion adapted to mount on a mounting surface, and wherein said operating plate is substantially coplanar with said housing lip portion when said lever arm is in its retracted position.

19. The mechanism defined in claim 17, wherein said lost motion interconnection means comprises pin means connected to and projecting from said lever arm and means for receiving therein said pin means connected to said first interconnecting means, said pin receiving means being configured so that said lever arm is free to move therein in response to rotation of said spool without causing said operating means to move toward its extended position, and so that said lever arm moves toward its extended position in response to movement of said operating means toward its extended position.

20. A mechanism for actuating a remote release unit, and comprising:

a housing, a lever arm directly and pivotally connected to said housing to define a pivot axis and to be pivotable thereabout between a first retracted position and a second extended position, said lever arm having a free end portion, an actuating member having one end connected to said lever arm free end portion and movable therewith, first actuator means for pivoting said lever arm from its retracted position to its extended position, and including operating means movable between retracted and extended positions, and first interconnecting means interconnecting said lever arm and said operating means such that the lever arm will be pivoted from its retracted position toward its extended position upon a corresponding movement of said operating means, said first interconnecting means extending between and connected to said lever arm and said operating means, and said first actuator means being directly connected to said housing, and second actuator means for pivoting said lever arm from its retracted position to its extended position independently of the operation of said first actuator means, and including take-up means rotatably mounted to said housing and second interconnecting means interconnecting said lever arm and said take-up means so that rotation of said take-up means in a first rotative direction causes said lever arm to pivot from its retracted position toward its extended position, said second interconnecting means extending between and connected to said lever arm and said take-up means, and said second actuator means being directly connected to said housing.

21. The mechanism defined in claim 20, wherein said actuating member comprises a cable including an external sheath fixed to said housing and slidably enclosing an intermediate portion of said cable so that movement of said lever arm between its retracted and extended positions causes said cable to slide relative to said sheath.

22. The mechanism defined in claim, 20, wherein said take-up means comprises a spool, and wherein said second interconnecting means comprises cable means having one end connected to said lever arm and a second end connected with said spool so that rotation of said spool causes said cable means to wind upon said spool and thereby pivot said lever arm from its retracted to its extended position.

23. The mechanism defined in claim 22, wherein said spool is rotatably mounted to said housing for rotation about a rotational axis which is substantially perpendicular to said pivot axis.

24. The mechanism defined in claim 23, wherein said first actuator means is pivotally interconnected with said housing.

25. The mechanism defined in claim 24, wherein said operating means is connected to said housing for pivotal movement about said pivot axis.

26. The mechanism defined in claim 25, wherein said operating means comprises an operating plate, and wherein said first interconnecting means includes lost motion interconnection means for causing said lever arm to pivot from its retracted position to its extended position upon a corresponding pivotal movement of said operating plate while permitting pivotal movement of said lever arm between its retracted and extended positions in response to rotation of said spool without causing a corresponding pivotal movement of said operating plate.

27. The chair defined in claim 26, further comprising a crank axle releasably connected to said spool receiving means.

28. The mechanism defined in claim 26, wherein said spool further includes means for receiving a releasably connectable crank axle for facilitating the rotation thereof.

29. The mechanism defined in claim 28, wherein said operating plate includes means aligned with the rotational axis of said spool which is adapted to receive the crank axle when the crank axle is connected with said spool.

30. The mechanism defined in claim 29, wherein said spool further comprises stop means for preventing counter rotation of said take-up means in a second rotative direction opposite said first rotative direction when said lever arm is in its retracted position.

31. A chair comprising a base, a seat, a backrest, means for reclining said chair between an upright position and at least one reclined position, and a mechanism for actuating movement of said chair from the upright position to a reclined position, said mechanism comprising:

a housing attached to said chair, a lever arm directly and pivotally connected to said housing to define a pivot axis and to be pivotable between a retracted position and an extended position, said lever arm having a free end portion, an actuating member connected at one end to and movable with said lever arm free end portion and at a second end to said reclining means so that movement of said actuating member responsive to the movement of said lever arm from the retracted position toward the extended position actuates said reclining means to move said chair from the upright position to one of said at least one reclined position, first actuator means for pivoting said lever arm from its retracted position to its extended position, and including operating means movable between retracted and extended positions and first interconnecting means interconnecting said lever arm and said operating means so that the lever arm will be pivoted from its retracted position toward its extended position upon a corresponding movement of said operating means, said first interconnecting means extending between and connected to said lever arm and said operating means, and said first actuator means being directly connected to said housing, and second actuator means for pivoting said lever arm from its retracted position to its extended position independently of the operation of said first actuator means, and including take-up means rotatably mounted to said housing and second interconnecting means interconnecting said lever arm and said take-up means so that rotation of said take-up means in a first rotative direction causes said lever arm to pivot from its retracted position toward its extended position, said second interconnecting means extending between and connected to said lever arm and said take-up means, and said second actuator means being directly connected to said housing.

32. The chair defined in claim 31, wherein said actuating member comprises a cable including an external sheath fixed to said housing and slidably enclosing an intermediate portion of said cable so that movement of said lever arm between its retracted and extended positions causes said cable to slide relative to said sheath and thereby actuate said reclining means.

33. The chair defined in claim 31, wherein said first actuator means is pivotally interconnected with said housing.

34. The chair defined in claim 31, wherein said take-up means comprises a spool, and said second interconnecting means comprises cable means having one end connected to said lever arm and a second end connected with said spool so that rotation of said spool causes said cable means to wind upon said spool and thereby pivot said lever arm from its retracted to its extended position.

35. The chair defined in claim 34, wherein said spool is rotatably mounted to said housing for rotation about a rotational axis which is substantially perpendicular to said pivot axis.

36. The chair defined in claim 34, wherein said operating means is connected to said housing for pivotal movement about said pivot axis.

37. The chair defined in claim 36, wherein said operating means comprises an operating plate, and wherein said first interconnecting means includes lost motion interconnection means for causing said lever arm to pivot from its retracted position to its extended position upon a corresponding pivotal movement of said operating plate while permitting pivotal movement of said lever arm between its retracted and extended positions in response to rotation of said spool without causing a corresponding pivotal movement of said operating plate.

38. The chair defined in claim 37, wherein said spool further includes means for receiving a releasably connectable crank axle for facilitating the rotation thereof.

39. The chair defined in claim 38, wherein said operating plate includes an aperture aligned with the rotational axis of said spool which is adapted to receive the crank axle when the crank axle is connected with said spool.

40. The chair defined in claim 39, wherein said spool further comprises stop means for preventing counter rotation of said take-up means in a second rotative direction opposite said first rotative direction when said lever arm is in its retracted position.

41. A chair comprising a base, a seat, a backrest, means for reclining said chair between an upright position and at least one reclined position, and a mechanism for actuating movement of said chair from the upright position to one of said at least one reclined position, said mechanism comprising:

a housing attached to said chair, an actuating member connected at one end to and movable with said reclining means so that movement of said actuating member along a path between first and second translatory positions actuates said reclining means to move said chair from the upright position to one of said at least one reclined position, first actuating means connected with said housing and said actuating member at a second end thereof for moving said actuating member along the path between its first and second translatory positions, said first actuating means being movable between first and second positions relative to said housing, wherein the actuating member moves between its first and second translatory positions responsive to movement of said first actuating means between its first and second positions; and second actuating means attached to said housing and said actuating member at said second end thereof for moving said actuating member along the path between its first and second translatory positions, said second actuating means including rotating means pivotable about an axis of rotation between first and second rotative positions, said axis of rotation being nonparallel with the path between the first and second translatory positions, wherein the actuating member moves between its first and second translatory positions responsive to the rotation of said rotating means between the first and second rotative positions.

42. The chair defined in claim 41, wherein said axis of rotation is substantially perpendicular to the path of the actuating member.

43. The chair defined in claim 41, wherein said second actuating means further includes means for receiving a releasably connectable crank axle for facilitating the rotation thereof.

44. The chair defined in claim 41, further comprising a lever arm pivotally connected to said housing to define a pivot axis and to be pivotable thereabout between a first position and a second position corresponding to the first and second translatory positions of the actuating member, said lever arm having a free end portion adapted to be connected with the actuating member, wherein said first actuating means further includes first means for interconnecting said lever arm with said first actuating means so that movement of said first actuating means from its first position to its second position causes said lever arm to move from its first position to its second position, and wherein said second actuating means further includes second means interconnecting said second actuating means with said lever arm so that rotation of said rotating means from its first rotative position to its second rotative position causes said lever arm to move from its first to its second position.

45. The chair defined in claim 44, wherein said rotating means comprises take-up means interconnected with said second interconnecting means, and wherein rotation of said rotating means from its first to its second rotative position causes said lever arm to draw the actuating member toward said housing.

46. The chair defined in claim 44, wherein said first actuating means is configured so that movement thereof from its first to its second position causes said lever arm to draw said actuating member toward said housing.

47. The chair defined in claim 44, wherein said lever arm pivot axis is substantially perpendicular to said second actuating means axis of rotation.

48. The chair defined in claim 44, wherein said first actuating means further comprises an operating plate moveable between a retracted and an extended position, wherein said lever arm moves between its first and second positions responsive to movement of said operating plate between its retracted and extended positions, and wherein in its retracted position, said operating plate defines a plane substantially orthogonal with the axis of rotation of said second actuating means.

* * * * *